United States Patent [19]

Kobayashi et al.

[11] Patent Number: 4,457,283

[45] Date of Patent: Jul. 3, 1984

[54] ELECTRONICALLY CONTROLLED FUEL INJECTION SYSTEM

[75] Inventors: Nobuyuki Kobayashi; Toshimitsu Ito, both of Aichi, Japan

[73] Assignee: Toyota Jidosha Kabushiki Kaisha, Toyota, Japan

[21] Appl. No.: 452,095

[22] Filed: Dec. 22, 1982

[30] Foreign Application Priority Data

Aug. 30, 1982 [JP] Japan ..... 57-149203
Aug. 30, 1982 [JP] Japan ..... 57-149204

[51] Int. Cl.[3] ..... F02B 3/00; F02B 33/00
[52] U.S. Cl. ..... 123/492; 123/493; 123/494
[58] Field of Search ..... 123/492, 493, 494

[56] References Cited

U.S. PATENT DOCUMENTS 3,858,561 1/1975 Aono ..... 123/492
4,391,250 7/1983 Matsui ..... 123/492

*Primary Examiner*—Ronald B. Cox
*Attorney, Agent, or Firm*—Finnegan, Henderson, Farabow, Garrett & Dunner

[57] ABSTRACT

In an electronically controlled engine supplying fuel from a fuel injector near an intake port to an intake system, asynchronous acceleration fuel injection is carried out in relation to the secondary differential $d^2X/dt^2$ of intake pipe pressure or intake air flow rate with respect to time t. Since the $d^2X/dt^2$ increases rapidly and accurately after the start of acceleration of the engine, the asynchronous acceleration fuel injection can be carried out rapidly and accurately.

10 Claims, 6 Drawing Figures

ELECTRONICALLY CONTROLLED FUEL INJECTION SYSTEM

BACKGROUND OF THE INVENTION

1. Field of the Invention

This invention relates to an electronically controlled fuel injection system for improving responsive property to acceleration of an engine.

2. Description of the Prior Art

In prior electronically controlled fuel injection systems computing basic fuel injection amounts in relation to intake pipe pressure P or intake air flow rate Q of an engine, a linear type throttle sensor for generating the output voltage which is a linear function of throttle opening $\theta$th is provided to correct air-fuel ratio during acceleration period in relation to the output of the throttle sensor and the intake pipe pressure P or intake air flow rate Q. In the acceleration from low load zone, however, the intake pipe pressure P or intake air flow rate Q increases remarkably as the throttle opening $\theta$th increases slightly, so that the air-fuel ratio during the acceleration period is difficult to control properly in response to the accelerated condition and the linear type throttle sensor is constructed more complicately than a contact type throttle sensor to increase cost.

SUMMARY OF THE INVENTION

An object of the present invention is to provide an electronically controlled fuel injection system which can properly control air-fuel ratio during acceleration period without using a linear type throttle sensor.

A further object of the present invention is to provide an electronically controlled fuel injection system which can rapidly carry out a first injection of a series of asynchronous acceleration fuel injections.

According to the present invention to achieve these objects, in an electronically controlled fuel injection system for operating a fuel injector according to electric signals to inject fuel from the fuel injector to an intake system, the secondary differential $d^2X/dt^2$ of intake pipe pressure or intake air flow rate with respect to time t is detected to carry out the asynchronous acceleration fuel injection in relation to this secondary differential $d^2X/dt^2$.

Since the asynchronous acceleration fuel injection is carried out on the basis of the secondary differential of X(=intake pipe pressure P or intake air flow rate Q) with respect to time, the asynchronous fuel injection can be carried out immediately after the start of acceleration while the fuel injection can be accurately carried out in relation to the accelerated condition.

Preferably a flag F is reset when an intake system throttle valve is opened from the idling opening, and the first asynchronous acceleration fuel injection is carried out when $F=0$ and $d^2X/dt^2>$ a predetermined value A while the flag F is set. The $d^2X/dt^2$ detected in a predetermined cycle is compared with a predetermined value B when $F=1$ and the asynchronous acceleration fuel injection is carried out once when $d^2X/dt^2>B$.

Preferably, fuel injection amount in the first asynchronous acceleration fuel injection is constant and the fuel injection amount from the second asynchronous acceleration fuel injection on is a function of $d^2X/dt^2$ and $A<B$. By setting $A<B$, the first asynchronous injection after the start of acceleration can be more rapidly carried out and the fuel injection amount can be made responsive to the accelerated condition by the fuel injection amount on and after the second asynchronous fuel injections which is a function of $d^2X/dt^2$.

Further according to the present invention, in the electronically controlled fuel injection system which operates the fuel injector according to electric signals to inject fuel from the fuel injector to the intake system, an amount $\Delta X$ of change in the intake pipe pressure or intake air flow rate during a predetermined time tc after the start of acceleration is detected to detect an amount $\Delta\Delta Xa$ of change in $\Delta X$ during a predetermined time ta. When $\Delta\Delta Xa>$ the predetermined value A, the initial asynchronous acceleration fuel injection is carried out to detect an amount $\Delta\Delta Xb$ of change in $\Delta X$ during an predetermined time tb shorter than ta in a predetermined cycle and when $\Delta\Delta Xb>$ the predetermined value B, the asynchronous acceleration fuel injections on and after the second time are carried out.

To carry out as promptly as possible the first one of a series of asynchronous acceleration fuel injections, A can be selected to have a small value. However, the value of A is limited in order to prevent wrong operations due to noise. Since according to this invention $\Delta\Delta Xa$ is the amount of change in $\Delta X$ during the sufficiently long time $ta(ta>tb)$ to be compared with A, the start of acceleration can be promptly detected to carry out the initial asynchronous acceleration fuel injection.

The accompanying drawings, which are incorporated in and constitute part of this invention, illustrate embodiments of the invention and, together with the description, serve to explain the principles of the invention.

DESCRIPTION OF THE PREFERRED EMBODIMENTS

Figure 1:
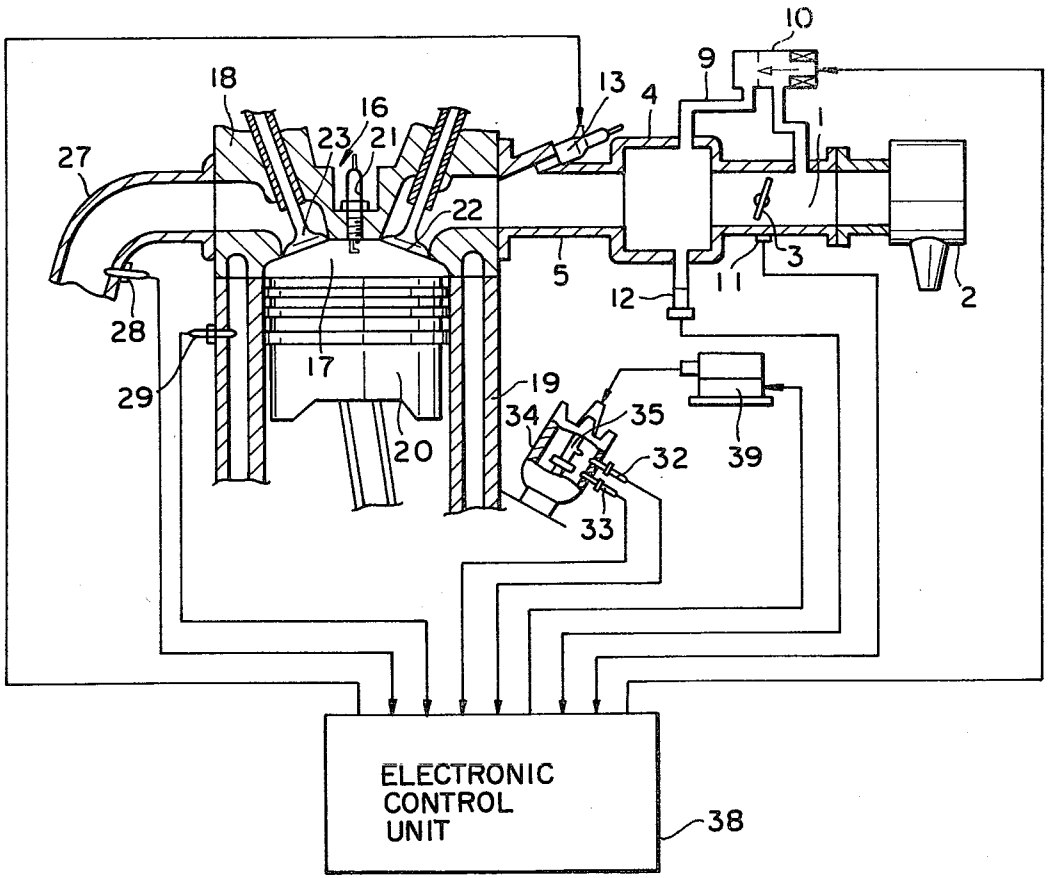
FIG. 1 is a schematic illustration of the whole electronically controlled engine according to the present invention.

In FIG. 1, are provided in an intake path 1 successively from the upstream side an air cleaner 2, throttle valve 3, surge tank 4 and intake pipe 5. A bypass path 9 interconnects the upstream of the throttle valve 3 and the surge tank 4 and has the sectional area of flow controlled by a controlling valve 10 for controlling a pulse motor. An idle switch 11 is turned on when the throttle valve 3 has the idling opening, and turned off when the throttle valve 3 is opened wider than the idling opening. A pressure sensor 12 detects intake pipe pressure P introduced from the surge tank 4. A fuel injector 13 provided near an intake port injects fuel to an intake system in relation to pulse signals of fuel injection. A combustion chamber 17 of an engine 16 is defined with a cylinder head 18, cylinder block 19 and piston 20 and provided with an ignition plug 21. Mixture is introduced to the combustion chamber 17 through an intake valve 22 and exhaust gas is discharged from the combustion chamber 17 through an exhaust valve 23 to an exhaust pipe 27. An oxygen sensor 28 as air-fuel ratio sensor is mounted on the exhaust pipe 27 to detect concentration of oxygen in the exhaust pipe. A water temperature sensor 29 is mounted on the cylinder block 19 to detect temperature of cooling water. A cylinder distinguishing sensor 32 and a rotation angle sensor 33 detect crank angle from the rotation of a rotary shaft 35 of a distributor 34 to generate one pulse at every change of 720° and 30° in the crank angle. An electronic control unit 38 receives the input signals from the respective sensors to send the output signals to an electromagnetic valve 10, the fuel injector 13 and an ignitor 39. The secondary ignition current of the ignitor 39 is sent to the ignition plug 21 in each combustion chamber 17 through the distributor 34.

Figure 2:
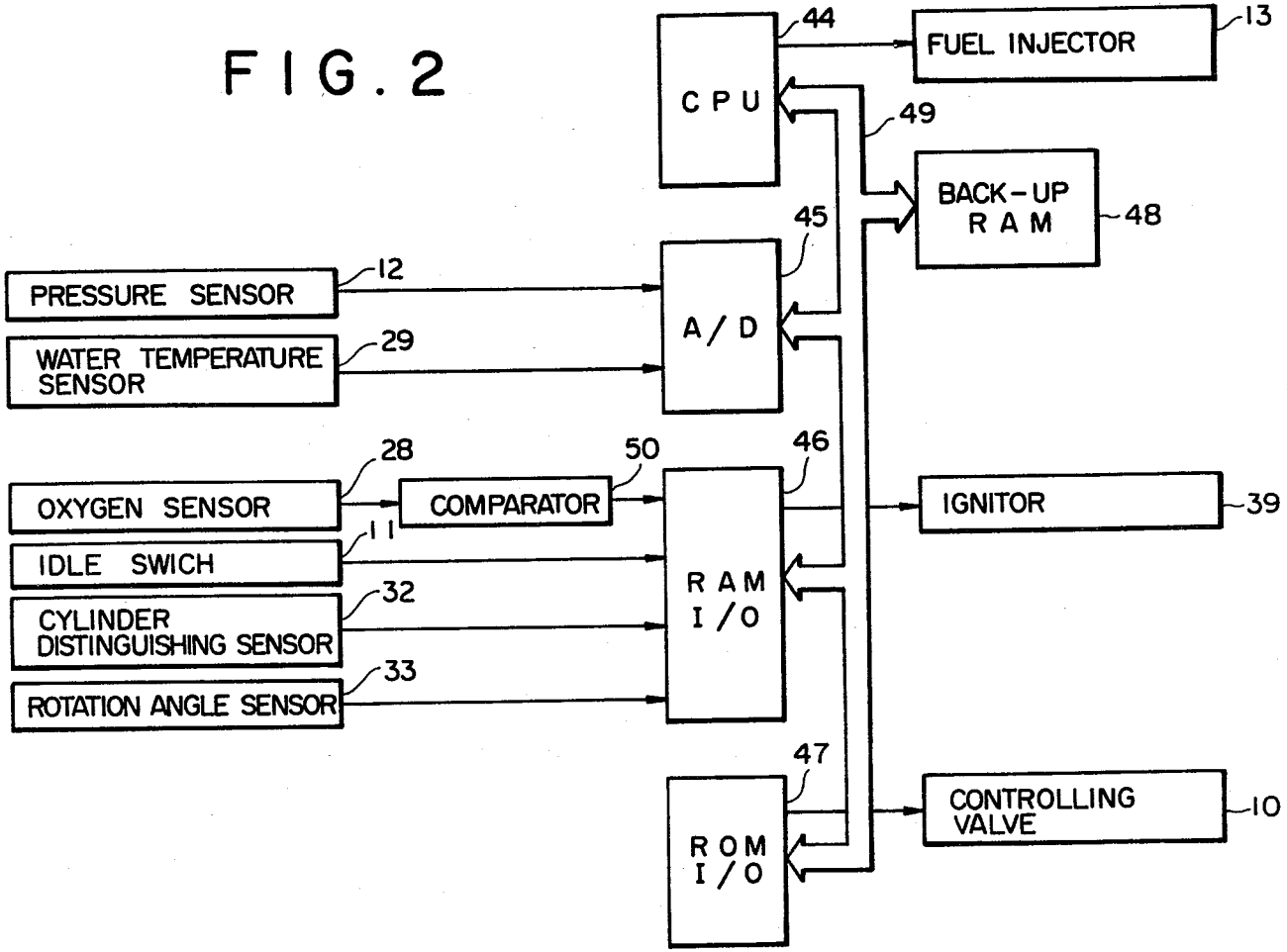
FIG. 2 is a block diagram of an electronic control unit.

FIG. 2 is a block diagram of the interior of the electronic control unit 38. CPU 44, A/D (analog/digital converter) 45, I/O (input-output interface) RAM 46, ROM·I/O 47 and back-up RAM 48 are connected to each other by a bus 49. The back-up RAM 48 is connected to the power supply to hold memory even while an engine switch is turned off. Analog signals of the pressure sensor 12 and water temperature sensor 29 are sent to the A/D 45. The outputs of the idle switch 11, cylinder distinguishing sensor 32 and rotation angle sensor 33 are sent to the I/O section of the I/O·RAM 46. The output of the oxygen sensor 28 is sent to the I/O section of the I/O·RAM 46 through a comparator 50. The fuel injector 13 receives the fuel injection pulses from CPU 44. The ignitor 39 receives the control signal from the I/O section of I/O·RAM 46. The controlling valve 10 for controlling the step motor receives control pulses from the I/O section of ROM·I/O 47.

Figure 3:
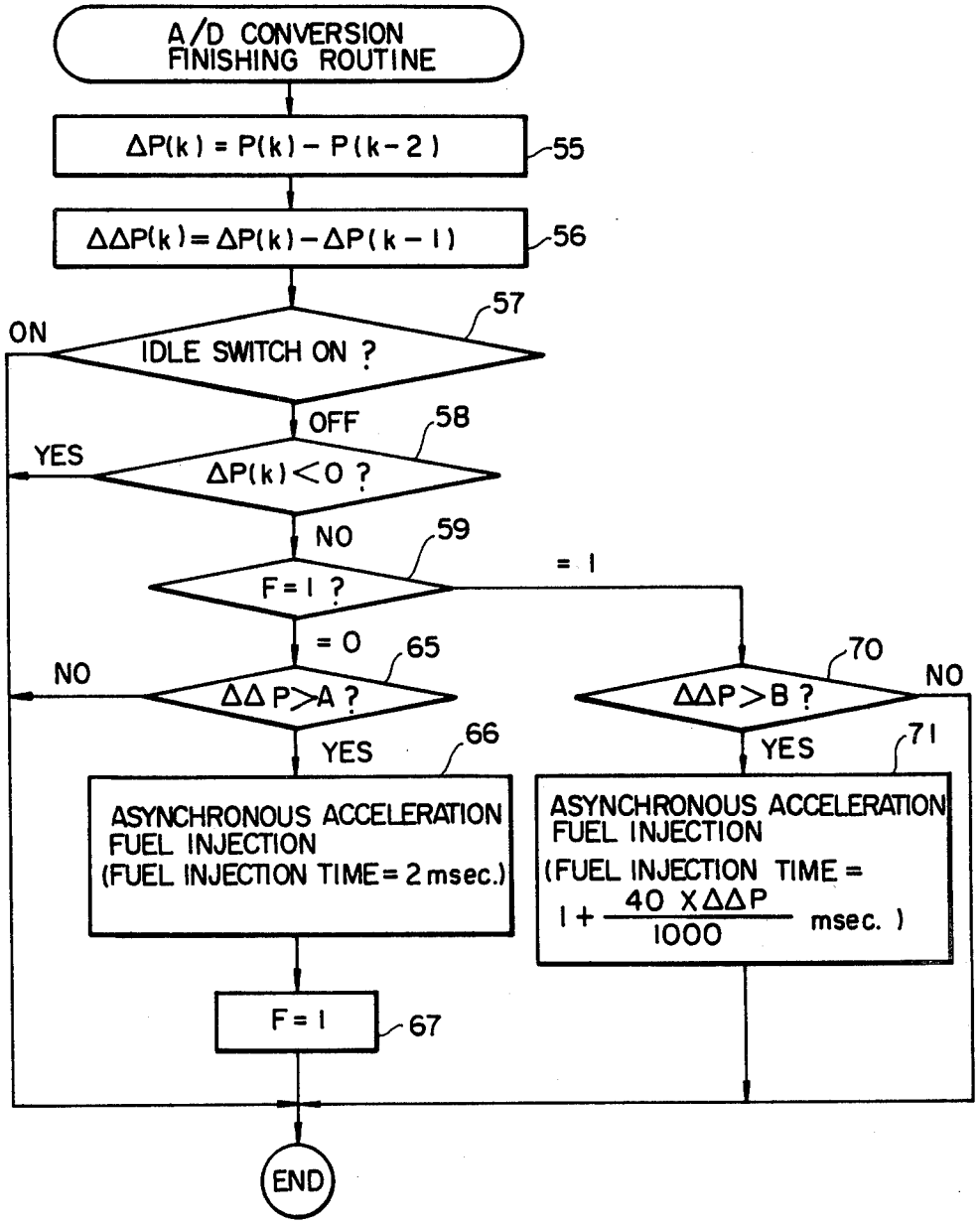
FIG. 3 is a flow chart of a program according to the present invention.

FIG. 3 is a flow chart of a program according to the present invention. The intake pipe pressure P as a value detected by the pressure sensor 12 is A/D converted every 10 msec., so that this program is implemented as an interrupting routine accompanying the completion of A/D conversion. On step 55 is computed the difference $P(k)-(k-2)$ between the intake pipe pressure $P(k)$ in this time and that $P(k-2)$ in the time before the previous one, i.e. before 20 msec., which is substituted in $\Delta P(k)$. $\Delta P$ as an amount in change of P per 20 msec. is equivalent to differential of P with respect to time t, i.e. $dP/dt$. On step 56, the difference $\Delta P(k)-\Delta P(k-1)$ between $\Delta P(k)$ in this time and $\Delta P(k-1)$ in the previous time, i.e., before 10 msec. is substituted in $\Delta\Delta P(k)$. $\Delta\Delta P$ as an amount of change in $\Delta P$ per 10 msec. is equivalent to the secondary differential of P with respect to time t, i.e., $d^2P/dt^2$. $\Delta\Delta P$ is set equal to the change in $\Delta P$ per 10 msec. not per 20 msec. so as to detect rapidly acceleration for carrying out step 68 which will be described later. On step 57 is judged whether the idle switch is turned on or off and the program carries out the following steps only the idle switch is turned off. Thus, the acceleration fuel injection is not carried out during deceleration. On step 58 is judged whether $\Delta P(k)<0$ or $\geqq 0$, the following steps are carried out only when $\Delta P(k)\geqq 0$. Thus, when the opening of the throttle is reduced to lower the intake pipe pressure, the acceleration fuel injection is not carried out. On step 59 is judged whether flag F is 1 or 0, and the program proceeds to step 65 when $F=0$ and to step 70 when $F=1$. The flag F is reset to be 0 when the idle switch 11 is to the turned off from the turned-on condition, i.e. when the throttle valve 3 is opened from the idling opening. Thus, $F=0$ in the initial execution of the program after the start of acceleration and the program proceeds to step 65 on which is judged whether or not $\Delta\Delta P(k)>$ the predetermined value A, and the program proceeds to the next step 66 only when $\Delta\Delta P(k)>A$. On the step 66, asynchronous acceleration fuel injection not in synchronization with the crank angle is carried out once. With this asynchronous acceleration fuel injection, the fuel injector 13 injects fuel into the intake system only for 2 msec. for example. Since A on step 65 is set to a value smaller than the predetermined value B on step 70 which will be described later, the first asynchronous acceleration fuel injection at the start of acceleration can be rapidly carried out. On step 67 is set the Flag F to 1. Thus, on step 59 is judged $F=1$ after the asynchronous acceleration fuel injection is carried out once, and the program proceeds to step 70. On the step 70 is judged whether or not $\Delta\Delta P(k)>$ predetermined value B and the program proceeds to step 71 only when $\Delta\Delta P(k)>B$. On step 71 is carried out the asynchronous acceleration fuel injection. Fuel injection time $\tau au$ in this asynchronous acceleration fuel injection is set to $1+(40\times\Delta\Delta P)/1000$ msec., where $\Delta\Delta P$ is a binary data stored as the secondary differential of P with respect to time t, i.e., $d^2P/dt^2$, in RAM. and 1 of $\Delta\Delta P<SB$ (the lowermost bit) corresponds to 1.22 mmHg. Thus, when $\Delta\Delta P$ is 50 mmHg, $\tau au$ is about 2.6 msec. Hence, the asynchronous acceleration fuel injection is carried out every 10 msec. during acceleration period and while $\Delta\Delta P(k)>B$ is maintained.

Figure 4:
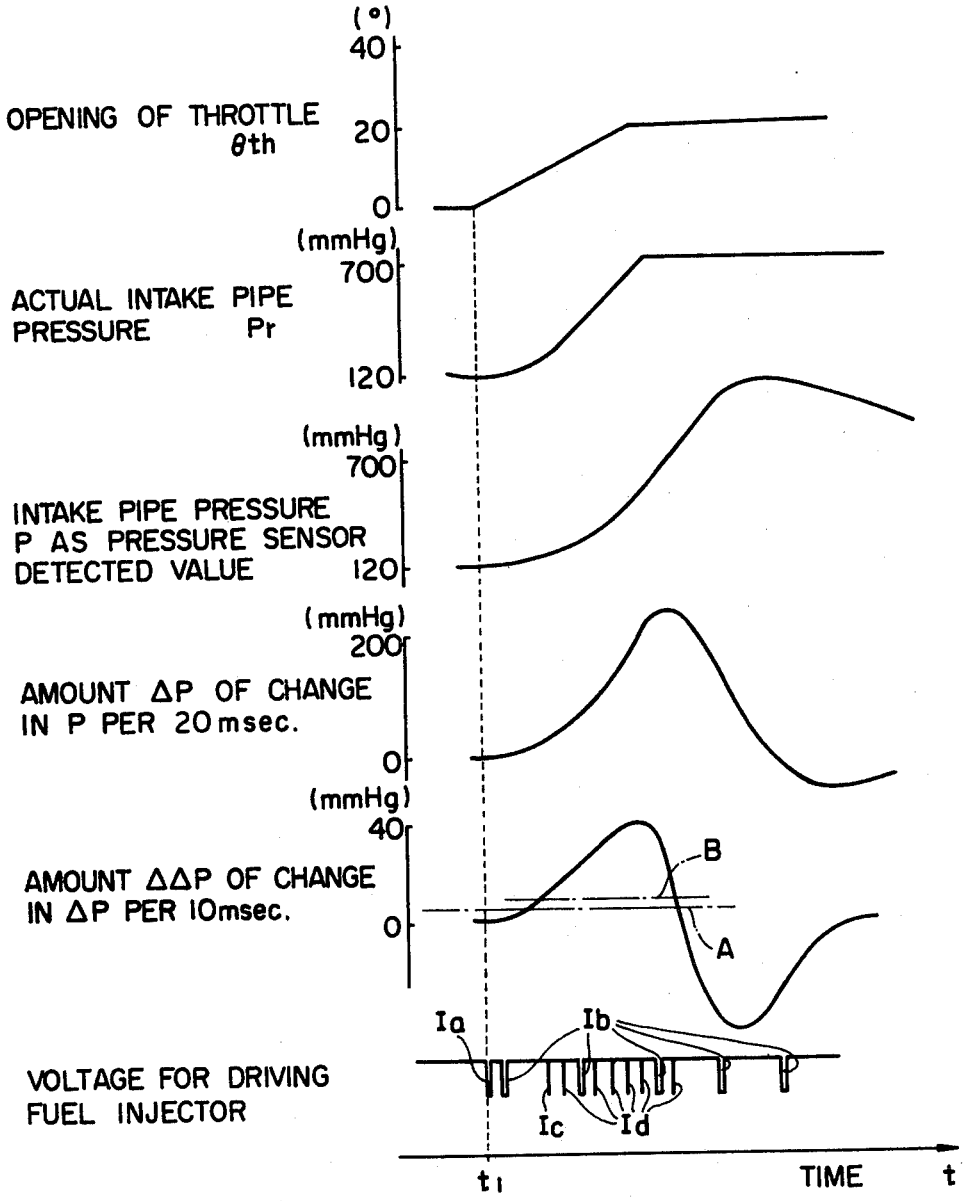
FIG. 4 is a graph showing change in time of voltage or the like for driving a fuel injector during acceleration period in the program shown in FIG. 3.

FIG. 4 shows changes in the opening $\theta th$ of the throttle during acceleration period, actual intake pipe pressure Pr, intake pipe pressure P detected by the pressure sensor 12, amount $\Delta P$ of change in P per 20 msec., amount $\Delta\Delta P$ of change in $\Delta P$ per 10 msec. and voltage for driving the fuel injection valve 13 with respect to time. The fuel injector 13 is maintained at the opened condition to inject fuel while the driving voltage is at low level. When the acceleration is started in time t1, the opening $\theta th$ of the throttle increases from 0°. Accordingly, the actual intake pipe pressure Pr increases and the intake pipe pressure P as the value detected by the pressure sensor 12 also increases. An over-shoot is generated in P. Fuel injection Ia is carried out when the idle switch 11 is changed over from the turned-on to turned-off condition. Ib is synchronous fuel injection carried out in synchronization with the crank angle and corresponds to an amount corrected by the basic fuel cooling water temperature as a function of injection amount P, thus engine load. Ic is asynchronous acceleration fuel injection carried out as the step 66 is executed and carried out after time t1 when $\Delta\Delta P$ exceeds the predetermined value A. Id is asynchronous acceleration fuel injection carried out as the step 71 is executed and carried out after the execution of Ic in 10 msec. cycle when $\Delta\Delta P>B$ is maintained. Since rise of $\Delta\Delta P$ in the start of acceleration is larger than that of $\Delta P$, the asynchronous acceleration fuel injection can be executed by detecting promptly and accurately the start of acceleration, and since the increase of $\Delta\Delta P$ reflects well the increase of the opening $\theta th$ of the throttle the asynchronous acceleration fuel injection Id can be carried out in response to the condition of acceleration.

Figure 5:
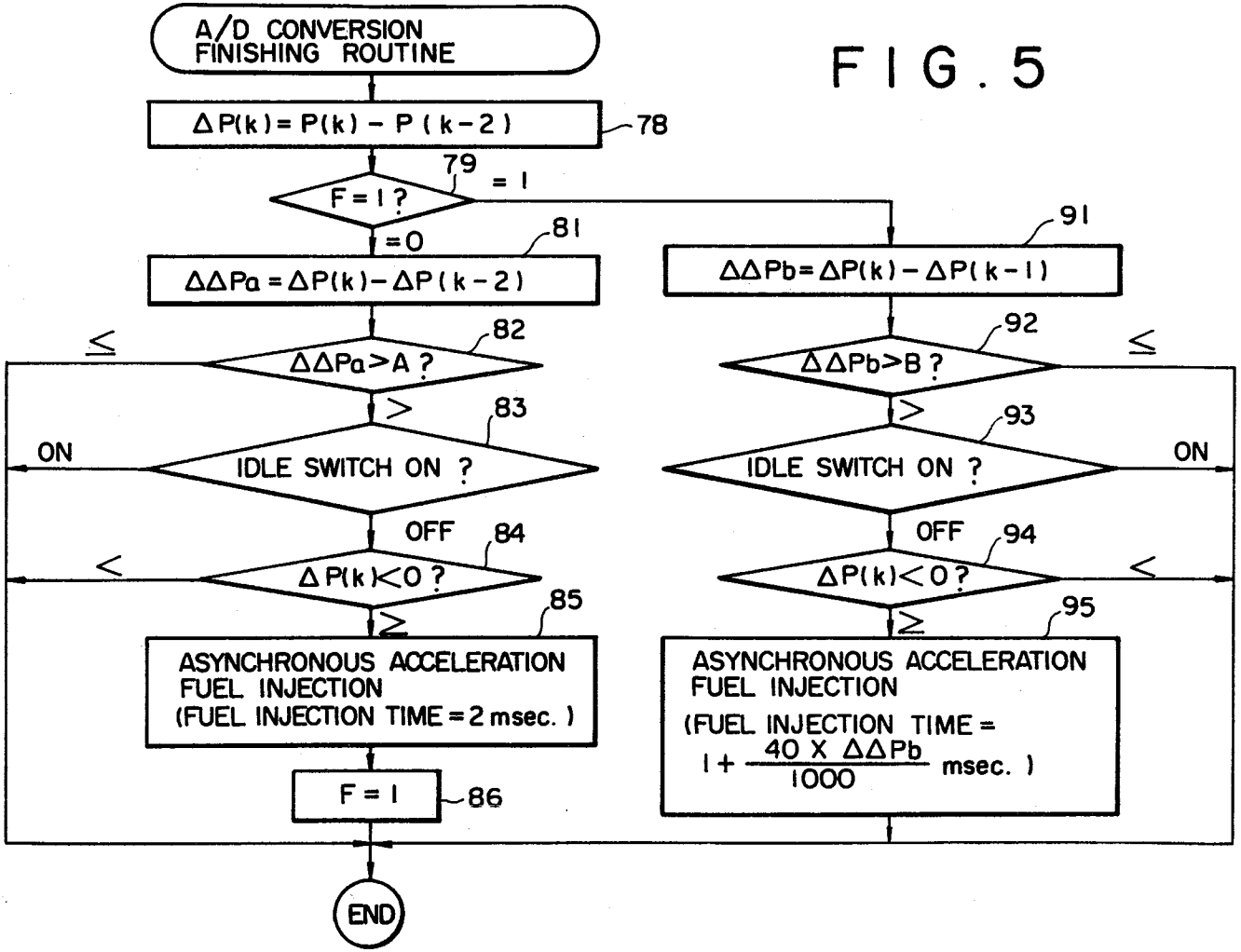
FIG. 5 is a further flow chart of the program according to the present invention.

FIG. 5 is a flow chart of another program according to the present invention. The intake pipe pressure P as the value detected by the pressure sensor 12 is A/D converted every 10 msec., and this program also is executed as in interrupting routine accompanying the completion of the A/D conversion. On step 78 is computed the difference $P(K)-P(k-2)$ between the intake pipe pressure $P(k)$ in this time and intake pipe pressure $P(k-2)$ in two times before this time, i.e. 20 msec. to be substituted in $\Delta P(k)$. $\Delta P$ as an amount of change in P per 20 msec. is equivalent to differential of P with respect to time t, i.e., dP/dt. On step 79 is judged whether flag F is 1 or 0, and the program proceeds to step 81 if $F=0$ and to step 91 if $F=1$. The flag F is reset when the idle switch 11 is changed over from the turned-on to turned-off condition, and set in step 86 which will be described later. Thus $F=0$ when the initial asynchronous acceleration fuel injection is not carried out, and the program proceeds to step 81, on which the difference $\Delta P(k)-\Delta P(k-2)$ between $\Delta P(k)$ in this time and $\Delta P(k-2)$ in two times before this time i.e., before 20 msec. is substituted in $\Delta\Delta Pa$. On step 82 is judged whether or not $\Delta\Delta Pa>$ predetermined value A, and the program proceeds to the succeeding step only when $\Delta\Delta P>A$. On step 83 is judged whether the idle switch 11 is turned on or off, and the program proceeds to succeeding step only when the switch is turned off. Thus, the asynchronous acceleration fuel injection during deceleration is to be avoided. On step 84 judged whether or not $\Delta P(k)<0$, and the program executes the succeeding step only when $\Delta P(k)\geqq 0$. Thus, the asynchronous acceleration fuel injection while P is decreased is to be avoided. On step 85 is carried out once asynchronous acceleration fuel injection not in synchronization with the crank angle. Fuel injection time in this asynchronous acceleration fuel injection is selected to be a constant value, for example 2 msec. Also since A on step 82 is selected to have a value smaller than that of B on step 92, the step 85 is to be executed promptly after acceleration. On step 86, the flag F is set to 1. Thus, $F=1$ is judged on step 79 from the next execution of the program. On step 91, the difference $\Delta P(k)-\Delta P(k-1)$ between $\Delta P(k)$ in this time $\Delta P(k-1)$ in the previous time, i.e. before 10 msec. is substituted in $\Delta\Delta Pb$. On step 92 is judged whether $\Delta\Delta Pb>B$ or $\leqq B$, and the program executes the succeeding step only when $\Delta\Delta Pb>B$, provided $B<A$. On step 93 is judged whether the idle switch 11 is turned on or off, and on step 93 is judged whether $\Delta P(k)<0$ or $\geqq 0$. The program proceeds to the succeeding step only when the idle switch 11 is turned off and $\Delta P(k)\geqq 0$. On step 95 is carried out the asynchronous acceleration fuel injection. Fuel injection time $\tau au$ in this asynchronous acceleration fuel injection is represented by formula similar to that on step 71 in FIG. 3.

Figure 6:
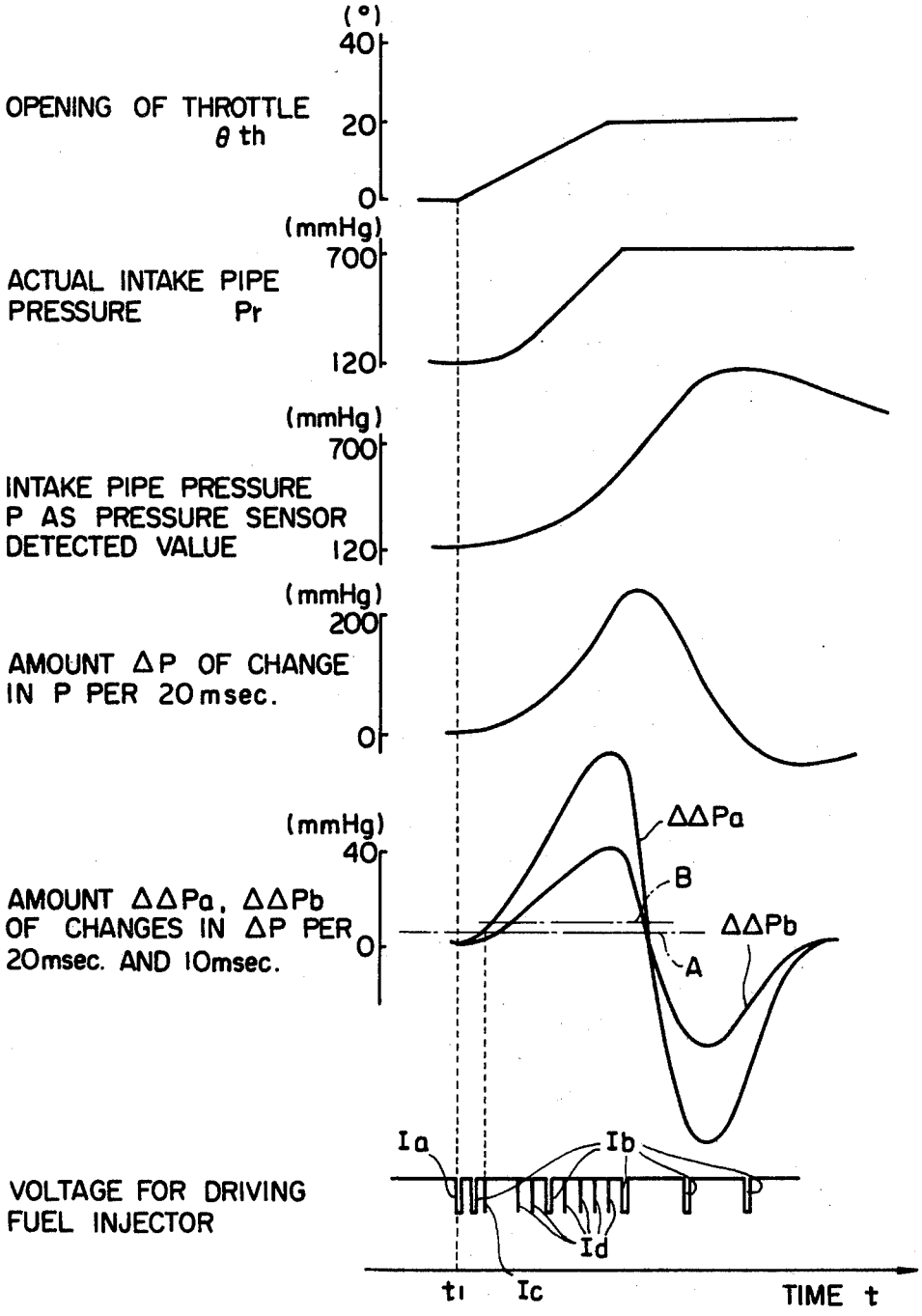
FIG. 6 is a graph showing the change in time of voltage or the like for driving the fuel injector during the acceleration period in the program shown in FIG. 5.

During an acceleration period when $\Delta\Delta Pb>B$ is maintained, step 95 is executed every 10 msec. to carry out the asynchronous acceleration fuel injection. In FIG. 6, are shown changes with respect to time in the opening $\theta$th of the throttle during acceleration period, actual intake pipe pressure Pr, intake pipe pressure P detected by the pressure sensor 12, amount $\Delta P$ of change in P per 20 msec., amounts $\Delta\Delta Pa$ and $\Delta\Delta Pb$ of changes in $\Delta P$ per 20 msec. and 10 msec. and voltage for driving the fuel injector 13. The fuel injector 13 is maintained open to inject fuel while the voltage for driving the valve is at low level. When acceleration is started at time t1, the opening $\theta$th of the throttle increases from 0°. Accordingly, the actual intake pipe pressure Pr increases and also the intake pipe pressure P as the value detected by the pressure sensor 12 increases. An overshoot is generated in P. Fuel injection Ia is carried out when the idle switch 11 is changed over from the turned-on condition to the turned-off one. Synchronous fuel injection Ib is carried out in synchronization with the crank angle and corresponds to the basic fuel injection amount corrected by cooling water temperature as a function of the intake pipe pressure P and thereby engine load. Asynchronous acceleration fuel injection Ic is carried out as the step 85 is executed and $\Delta\Delta Pa$ exceeds the predetermined value A after time t1. Asynchronous acceleration fuel injection Id is carried out as the step 91 is executed and carried out in 10 msec. cycle after the execution of the Ic while $\Delta\Delta Pb>B$ is maintained. Since $\Delta\Delta Pa$ and $\Delta\Delta Pb$ in the start of acceleration rise larger than $\Delta P$, the start of acceleration is to be detected promptly and accuratedly to execute the asynchronous acceleration fuel injection. Since particularly $\Delta\Delta Pa$ rises largely as the acceleration is started, the first asynchronous acceleration fuel injection by the execution of the step 85 is prompted. Also, the increase of $\Delta\Delta Pb$ reflects well the increase of the opening $\theta$th of throttle so that the asynchronous acceleration fuel injection Id is to be carried out in response to the condition of acceleration.

While an electronic control engine is shown in this embodiment which computes the basic fuel injection amount according to the intake pipe pressure P, this invention, of course, is applicable to an electronic control engine which computes the basic fuel injection amount according to the intake air flow rate Q. In this case, P, $\Delta P$ and $\Delta\Delta P$ in the flow charts of FIGS. 3 and 5 and in graphs of FIGS. 4 and 6 are replaced respectively by Q, $\Delta Q$ and $\Delta\Delta Q$.

While it will be apparent that the embodiments of the invention herein disclosed are well calculated to fulfill the objects of the invention, it will be appreciated that the invention is susceptible to modification, variation and change without departing from the proper scope or fair meaning of the subjoined claims.

What is claimed is:

1. An electronically controlled fuel injection system for operating a fuel injector according to electric signals to inject fuel from the fuel injector to an intake system, comprising a means for detecting the secondary differential with respect to time $d^2X/dt^2$ of a quantity X where X is either intake pipe pressure or intake air flow rate, and a means for carrying out an asynchronous acceleration fuel injection on the basis of said secondary differential $d^2X/dt^2$.

2. An electronically controlled fuel injection system as defined in claim 1, further comprising a means for carrying out a single first asynchronous acceleration fuel injection when $d^2X/dt^2$ is greater than a first predetermined value A and a means for detecting $d^2X/dt^2$ in a predetermined cycle after said first asynchronous acceleration fuel injection to carry out subsequent asynchronous acceleration fuel injections if the detected $d^2X/dt^2$ is greater than a second predetermined value B.

3. An electronically controlled fuel injection system as defined in claim 2, further comprising a digital signal flag F and means for resetting said flag F when an intake system throttle valve is opened from the idling opening, a means for carrying out said first asynchronous acceleration fuel injection when said flag F is reset and $d^2X/dt^2$ is greater than said predetermined value A and for setting said flag F, and a means for carrying out said subsequent asynchrononous fuel injections when said flag F is set and $d^2X/dt^2$ is greater than said predetermined value B.

4. An electronically controlled fuel injection system as defined in claim 1, wherein the fuel injection amount in said first asynchronous fuel injection is constant and the fuel injection amount in said subsequent asynchronous acceleration fuel injections is a function of $d^2X/dt^2$.

5. An electronically controlled fuel injection system as defined in claim 2 or 3, wherein said predetermined value A is less than said predetermined value B.

6. An electronically controlled fuel injection system for operating a fuel injection valve according to electric signals to inject fuel from a fuel injector to an intake system, comprising a means for detecting a change $\Delta X$ in a quantity X where X is either intake pipe pressure or intake air flow rate during a predetermined time to after the start of acceleration, a means for detecting a change $\Delta\Delta Xa$ in $\Delta X$ during the predetermined time ta to carry out a first asynchronous acceleration fuel injection if $\Delta\Delta Xa$ is greater than a first predetermined value A, and a means for detecting a change $\Delta\Delta Xb$ in $\Delta X$ in a predetermined time tb shorter than ta in a predetermined cycle to carry out subsequent asynchronous acceleration fuel injections if $\Delta\Delta Xb$ is greater than a second predetermined value B.

7. An electronically controlled fuel injection system as defined in claim 6, further comprising a digital signal flag F and means which sets said flag F when said first asynchronous acceleration fuel injection is carried out and which judges whether or not $\Delta\Delta Xb$ is greater than said second predetermined value B when said flag F is set.

8. An electronically controlled fuel injection system as defined in claim 1 or 7, wherein said first predetermined value A is less than said predetermined value B.

9. An electronically controlled fuel injection system as defined in claim 6, wherein the fuel injection time in said first asynchronous acceleration fuel injection is constant and the fuel injection time in said subsequent asynchronous acceleration fuel injections is a function of $\Delta\Delta Xb$.

10. An electronically controlled fuel injection system as defined in claim 6, wherein tc=ta.

* * * * *

UNITED STATES PATENT AND TRADEMARK OFFICE

CERTIFICATE OF CORRECTION

PATENT NO. : 4,457,283

DATED : July 3, 1984

INVENTOR(S) : N. KOBAYASHI

It is certified that error appears in the above-identified patent and that said Letters Patent is hereby corrected as shown below:

In Claim 6, Column 7, line 15, change "time to" to -- time tc --.

Signed and Sealed this

*Twenty-ninth* Day of *January 1985*

[SEAL]

*Attest:*

DONALD J. QUIGG

*Attesting Officer* *Acting Commissioner of Patents and Trademarks*